United States Patent [19]

Bergmeister

[11] Patent Number: 4,607,407

[45] Date of Patent: Aug. 26, 1986

[54] CAN TAB OPENER

[76] Inventor: Josef J. Bergmeister, P.O. Box 421713, San Francisco, Calif. 94142

[21] Appl. No.: 745,089

[22] Filed: Jun. 17, 1985

[51] Int. Cl.[4] ..... B67B 7/44

[52] U.S. Cl. ..... 7/156; 81/3.09

[58] Field of Search ..... 81/3.09, 3.55, 3.57; 7/151, 152, 156; D8/18, 33, 40

[56] References Cited

U.S. PATENT DOCUMENTS

| | | | |
|---|---|---|---|
| D. 163,422 | 5/1951 | Runkle et al. | 7/152 |
| 810,538 | 1/1906 | Jelks | 7/151 |
| 1,697,974 | 1/1929 | Funk | 7/152 |
| 4,133,228 | 1/1979 | DePooter | 81/3.09 |
| 4,253,352 | 3/1981 | O'Neal | 81/3.55 |
| 4,257,287 | 3/1981 | Dawson . | |
| 4,391,167 | 7/1983 | Bergmeister | 81/3.55 |

FOREIGN PATENT DOCUMENTS

| | | | |
|---|---|---|---|
| 2508025 | 9/1976 | Fed. Rep. of Germany | 81/3.55 |
| 1575063 | 9/1980 | United Kingdom | 7/152 |

*Primary Examiner*—Roscoe V. Parker
*Attorney, Agent, or Firm*—Harvey B. Jacobson

[57] ABSTRACT

An elongated lever member is provided defining first and second ends and the lever member comprises a flat stock member with the first and second ends each being of a greater width than the intermediate length portion of the flat stock member extending between and connecting the ends. One of the ends includes opposite side portions projecting outwardly beyond the corresponding opposite side portions of the intermediate length portion and those opposite side portions are reversely bent back over one face surface of the corresponding end of the flat stock member in closely laterally spaced relation thereto and with the free ends of the reversely bent side portions secured together to form an open ended sleeve on the side of the one end of the flat stock member opposed by the reversely bent portions. The sleeve tapers toward the other end of the flat stock member and the flat stock member other end includes an opening therein which may be partially engaged over a bottle cap for removal of the latter.

7 Claims, 6 Drawing Figures

CAN TAB OPENER

BACKGROUND OF THE INVENTION

1. Field of the Invention

This invention relates to the can opener field and more specifically to an opener to be used in conjunction with various different forms of can tabs including pop-tabs, ring-top tabs and the various different forms of pop-top tabs. In addition, the opener is also specifically adapted for removing bottle tops and non-threaded jaw tops.

2. Description of Related Art

Various different forms of lift or pop-top can openers as well as other forms of cam and jar openers heretofore have been provided such as those disclosed in U.S. Pat. Nos. 4,253,352, 4,257,287 and my prior U.S. Pat. No. 4,391,167. However, these previously known forms of can openers do not include the specific structural features of the instant invention, nor are they operable for use in opening any different forms of containers.

SUMMARY OF THE INVENTION

The opener of the instant invention is specifically adapted to be used in conjunction with pop-top can tabs, ring-type pull tabs, conventional bottle caps, jar caps and other forms of pull tabs.

The opener includes an elongated lever member defining a longitudinally extending sleeve on one end tapered toward the other end and the other end of the lever member is equipped with an opening formed therein which may be engaged over a bottle top and beneath one lip portion thereof for removal of the bottle top.

The main object of this invention is to provide a can, bottle and jar opener which may be used to open substantially all conventional present day tab equipped cans and cap equipped bottles and jars of the non-threaded type.

Another object of this invention is to provide an opener whose working features may be readily constructed from a single piece of flat stock material.

A further object of this invention is to provide a container opener in accordance with the preceding objects and adapted for opening other types of containers.

A final object of this invention to be specifically enumerated herein is to provide a container opener in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
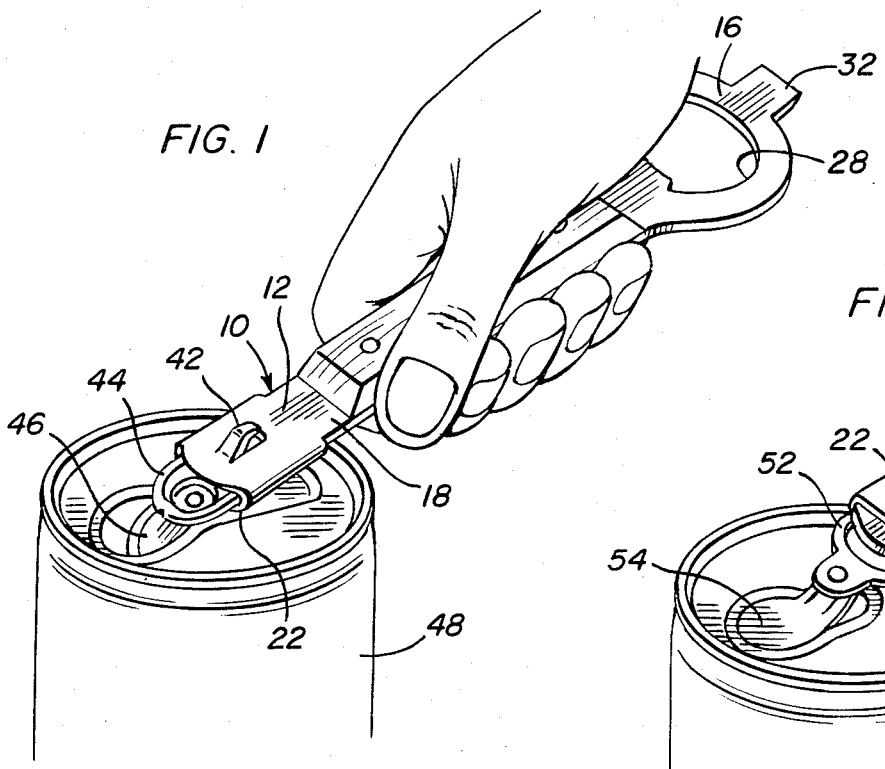
FIG. 1 is a perspective view of the preferred form of can opener of the instant invention in use engaged with a depressible can top tab portion.

Referring now more specifically to the drawings, the numeral 10 generally designates the cam opener of the instant invention. The opener 10 includes an elongated lever member 12 comprising a flat stock member and having opposite ends 14 and 16 which are each of a greater width than the intermediate length portion 18 of the member 12 extending between the ends 14 and 16.

The end 14 includes opposite side portions 20 and 22 which project outwardly beyond the corresponding side portions of the intermediate length portion 18 and are reversely bent back over one side face 24 of the member 12 in spaced relation relative thereto. The free ends of the reversely bent portions 20 and 22 are joined together as at 26 and the joined portions 20 and 22 coact with the center portion of the end 14 to form an open ended sleeve on the corresponding side of the member 12, the sleeve being slightly tapered toward the end 16.

The greater width end 16 has an opening 28 formed therein and defines a short tongue portion 30 extending into the side of the opening 28 adjacent the end 14. The opening 28 is adapted to fit over a bottle cap to a point adjacent one side thereof with the tongue 30 disposed beneath the remote side of the bottle cap. In addition, the end 16 include a thickness tapered tang 32 projecting endwise outwardly of the terminal end thereof and the end 14 includes a bevelled outer arcuate edge equipped extension 34 projecting slightly beyond the portions 20 and 22 remote from the end 16.

The intermediate length portion 18 includes opposite side strips 36 and 38 secured thereto by rivets 40 and the strips 36 and 38 serve not only to define an enlarged handgrip for the intermediate length portion 18 but also to reinforce the latter against flexure during usage of the opener 10.

Figure 5:
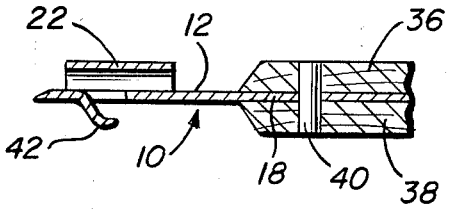
FIG. 5 is a fragmentary longitudinal vertial sectional view taken substantially upon the plane indicated by the section line 5—5 of FIG. 4.

With attention now invited more specifically to FIG. 5 of the drawings, it may be seen that the portion of the end 14 underlying the portions 20 and 22 has a rearwardly opening hook 42 struck therefrom.

Figure 2:
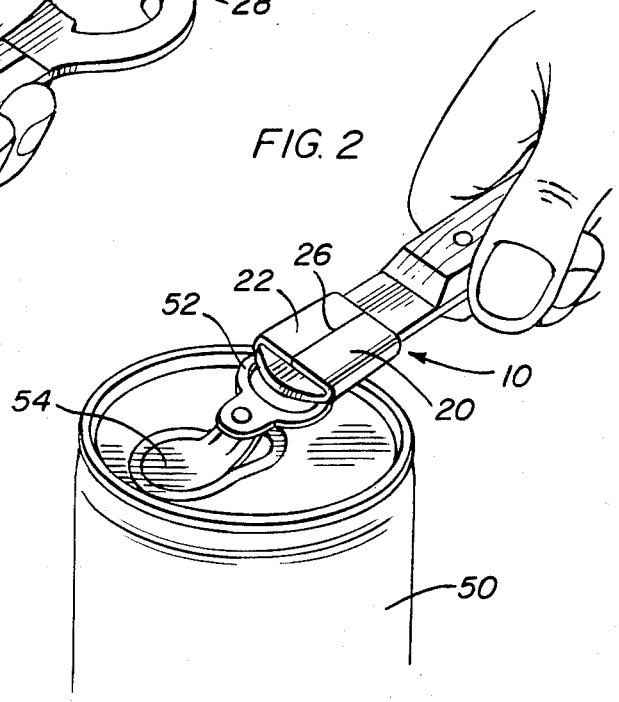
FIG. 2 is a fragmentary perspective view of the can opener in use in conjunction with a pop-top pull tab.
Figure 3:
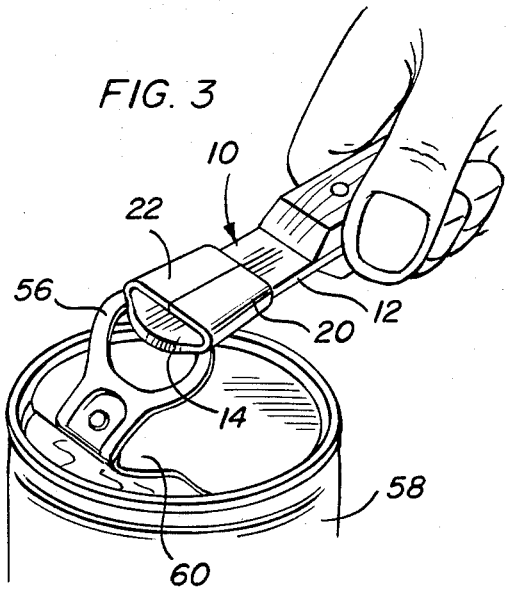
FIG. 3 is a fragmentary perspective view of the can opener in use in conjunction with a ring-top opener.

With attention now invited more specifically to FIG. 1 of the drawings, it may be seen that the opener 10 may be engaged with the tab lever of a tab equipped can top of the type wherein the tab is depressible down into the interior of the can. The end 14 is advanced toward the lever 44 of the downwardly depressible tab 46 with the bevelled edge equipped extension 34 passing beneath the free end of the lever so as to guide the lever 44 into the sleeve defined by the reversely bent portions 20 and 22. Then, the member 12 may be used as a lever to upwardly pry the lever 44 and downward depress the tab 46 in order to open the top of the associated can 48. On the other hand, if a can 50 is provided with the older style pull tab, the hook 42 of the opener 10 may be engaged with the pull ring 52 of the pull tab 54 in order to remove the same from the top of the can 50, see FIG. 2. Further, the hook 42 may be engaged with the pull ring 56 of a ring-top can 58 to remove the top 60, see FIG. 3.

The tang 32 may be used to pry open non-threaded jar tops and to facilitate the opening of other containers.

Figure 6:
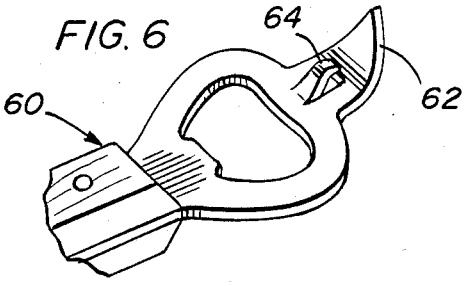
FIG. 6 is a fragmentary perspective view of a slightly modified form of an opener constructed in accordacne with the present invention.
Figure 4:
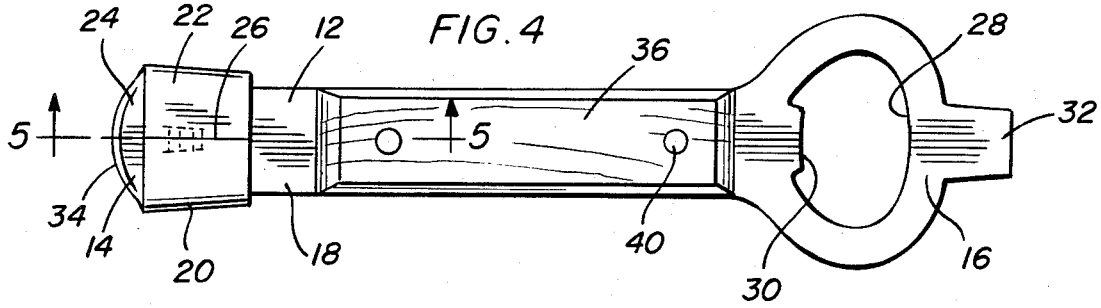
FIG. 4 is a plan view of the preferred form of opener.

With attention now invited more specifically to FIG. 6 of the drawings, a modified form of opener is referred to by the reference numeral 60. The opener 60 is substantially identical to the opener 10, except that instead of being provided with a tang corresponding to the tang 32 of the opener 10, the corresponding end of the opener 60 is provided with a pointed and hooked bill 62 equipped with a can rim engaging hook 64. The bill 62 and the hook 64 may, of course, be used to punch triangular openings in can tops which are not provided with pull tabs.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A lift-top can opener including an elongated lever member defining first and second ends, said lever member comprising a flat stock member and said ends each being of greater width than the intermediate length portion of said flat stock member extending between and connecting said ends, said ends each including opposite side portions projecting outwardly beyond the corresponding opposite side portions of said intermediate length portion, the opposite side portions of one of said greater width ends being reversely bent back over one face surface of the corresponding end of said flat stock member in closely laterally spaced relation relative thereto and with the free ends of said reversely beat portions secured together to form an open ended sleeve on the side of said one end opposed by said reversely bent portions, said one greater width end including a bevelled arcuate edge equipped extension projecting slightly outwardly beyond said opposite side portions, said sleeve tapering in width, measured transversely of said one face toward the other end of said lever member.

2. The can opener of claim 1 wherein the other end of said lever member includes an opening formed therethrough having an edge portion remote from said one end adapted to be engaged over the top of a bottle cap and further includes a tongue portion projecting into the portion of said opening adjacent said one end adapted to be engaged beneath the edge of a bottle cap.

3. The can opener of claim 1 wherein said other end includes an outwardly tapered tang forming a terminal end extension of said other end.

4. The can opener of claim 1 wherein a major portion of the length of said intermediate length portion includes a pair of elongated longitudinally extending opposite side thick plates secured thereto and defining an enlarged handgrip portion for said flat stock member intermediate said first and second ends and further serving as reinforcement of said intermediate length portion against flexure thereof.

5. The can opener of claim 1 wherein said other end includes a curved and pointed bill supported therefrom and defining a terminal extension thereof, said bill including a hook on the concave side thereof opening toward the pointed extremity of said bill.

6. The can opener of claim 5 wherein the other end of said lever member includes an opening formed therethrough having an edge portion remote from said one end adapted to be engaged over the top of a bottle cap and further including a tongue portion projecting into the portion of said opening adjacent said one end adapted to be engaged beneath the edge of a bottle cap, said opening being disposed inwardly of said bill.

7. The can opener of claim 1 wherein said other end includes an outwardly tapered tang forming a terminal end extension of said other end, the other end of said lever member including an opening formed therethrough having an edge portion remote from said one end adapted to be engaged over the top of a bottle cap and further including a tongue portion projecting into the portion of said opening adjacent said one end adapted to be engaged beneath the edge of a bottle cap, said opening being disposed inwardly of said tang.

* * * * *